US005996229A

United States Patent [19]

Yang

[11] Patent Number: 5,996,229

[45] Date of Patent: Dec. 7, 1999

[54] METHOD AND MOLD DIE FOR FORMING A SPIRAL BEVEL GEAR FROM METAL POWDERS

[76] Inventor: Tsung-Hsun Yang, No. 2, Lane 108, Yung-Feng Rd., Tai-Ping City, Taichung Hsien, Taiwan

[21] Appl. No.: 09/161,106

[22] Filed: Sep. 25, 1998

[51] Int. Cl.[6] ..... B21D 28/00

[52] U.S. Cl. ..... 29/893.34; 72/355.6

[58] Field of Search ..... 29/893.3, 893.34; 72/355.6, 359; 74/385, 459.5

[56] References Cited

U.S. PATENT DOCUMENTS

| | | | |
|---|---|---|---|
| 2,542,912 | 2/1951 | Ensign | 72/349 |
| 4,924,690 | 5/1990 | Kanamaru | 29/893.34 |

FOREIGN PATENT DOCUMENTS

| | | | |
|---|---|---|---|
| 584907 | 3/1994 | European Pat. Off. | 29/893.34 |

*Primary Examiner*—P. W. Echols
*Attorney, Agent, or Firm*—Fish & Richardson P.C.

[57] ABSTRACT

A method and a mold die are provided for forming a spiral bevel gear from metal powders. The method includes the steps of: (a) providing a mold die having a die cavity that includes a middle segment corresponding to a contour of a spiral bevel gear, an upper segment corresponding to a contour of a first spiral gear and disposed immediately above the middle segment to form a first juncture, and a lower segment corresponding to a contour of a second spiral gear and disposed immediately beneath the middle segment to form a second juncture; (b) closing the lower segment by screwing the second spiral gear in the lower segment; (c) filling the die cavity with metal powders; (d) closing the cavity by screwing the first spiral gear into the upper segment; (e) pressing the metal powders by continuing the screwing actions of the first and second spiral gears until the second spiral gear reaches the second juncture and the first spiral gear stops short of the first juncture to form a green compact which acquires a shape of a combination of the bevel spiral gear and a residual portion; (f) screwing the first spiral gear out of the first segment; and (g) gradually screwing the second spiral gear towards the middle segment such that the residual portion is rotated along the upper segment in order to eject the green compact out of the middle and upper segments.

6 Claims, 5 Drawing Sheets

METHOD AND MOLD DIE FOR FORMING A SPIRAL BEVEL GEAR FROM METAL POWDERS

BACKGROUND OF THE INVENTION

1. Field of the Invention

This invention relates to a method for forming a spiral bevel gear, more particularly to a method and mold die for forming a spiral bevel gear from metal powders.

2. Description of the Related Art

To form a spiral gear, referring to FIG. 1, a conventional mold die 10 has a die cavity 111 that corresponds to a contour of the spiral gear. The die cavity 111 has a plurality of spiral threads 112 to correspond to the spiral teeth of the spiral gear. Upper and lower spiral gears 12,13 have spiral teeth 121,131 which conform to the spiral teeth of the spiral gear. After filling the die cavity 111 with metal powders, the upper and lower spiral gears 12, 13 are screwed from the top and bottom of the die cavity 111 so as to form a green compact 14.

Therefore, after the upper spiral gear 12 is screwed out of the die cavity 111, the lower spiral gear 13 is screwed gradually upward so as to eject the green compact 14 out of the die cavity 111 by the threaded rotation of the green compact 14 in view of the threaded engagement between its spiral teeth and the spiral threads 112 of the die cavity 111.

However, the method described above and the mold die 11 are not suitable for forming a spiral bevel gear because the spiral bevel gear has different diameters and is difficult to be removed from the die cavity of such mold die. An additional machining process, such as a thread milling process, is required to form the spiral teeth of the spiral bevel gear, thereby resulting in inconvenience during manufacturing and adversely affecting the quality of products.

SUMMARY OF THE INVENTION

The object of the present invention is to provide a method and mold die for forming a spiral bevel gear from metal powders, thereby simplifying the manufacturing process for the spiral bevel gear.

According to this invention, a method for forming a spiral bevel gear from metal powders, includes the steps of: (a) providing mold die having a die cavity that includes including a middle segment which is adapted to correspond to a contour of a spiral bevel gear and which has first spiral threads, an upper segment which is adapted to correspond to a contour of a first spiral gear, which has second spiral threads conforming to and extending from the first spiral threads, and which is disposed immediately above the middle segment to form a first juncture, and a lower segment which is adapted to correspond to a contour of a second spiral gear, which has third spiral threads, and which is disposed distal to the upper segment immediately beneath the middle segment to form a second juncture; (b) closing the lower segment from the bottom by screwing the second spiral gear in the lower segment; (c) filling the die cavity with metal powders; (d) closing the cavity by screwing the first spiral gear into the upper segment; (e) pressing the metal powders by continuing the screwing actions of the first and second spiral gears until the second spiral gear reaches the second juncture and the first spiral gear stops short of the first juncture to form a green compact which acquires a shape of a combination of the bevel spiral gear and a residual portion of the first spiral gear; (f) screwing the first spiral gear out of the first segment; and (g) gradually screwing the second spiral gear towards the middle segment such that the residual portion is rotated threadedly along the second spiral threads in order to eject the green compact out of the middle and upper segments.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
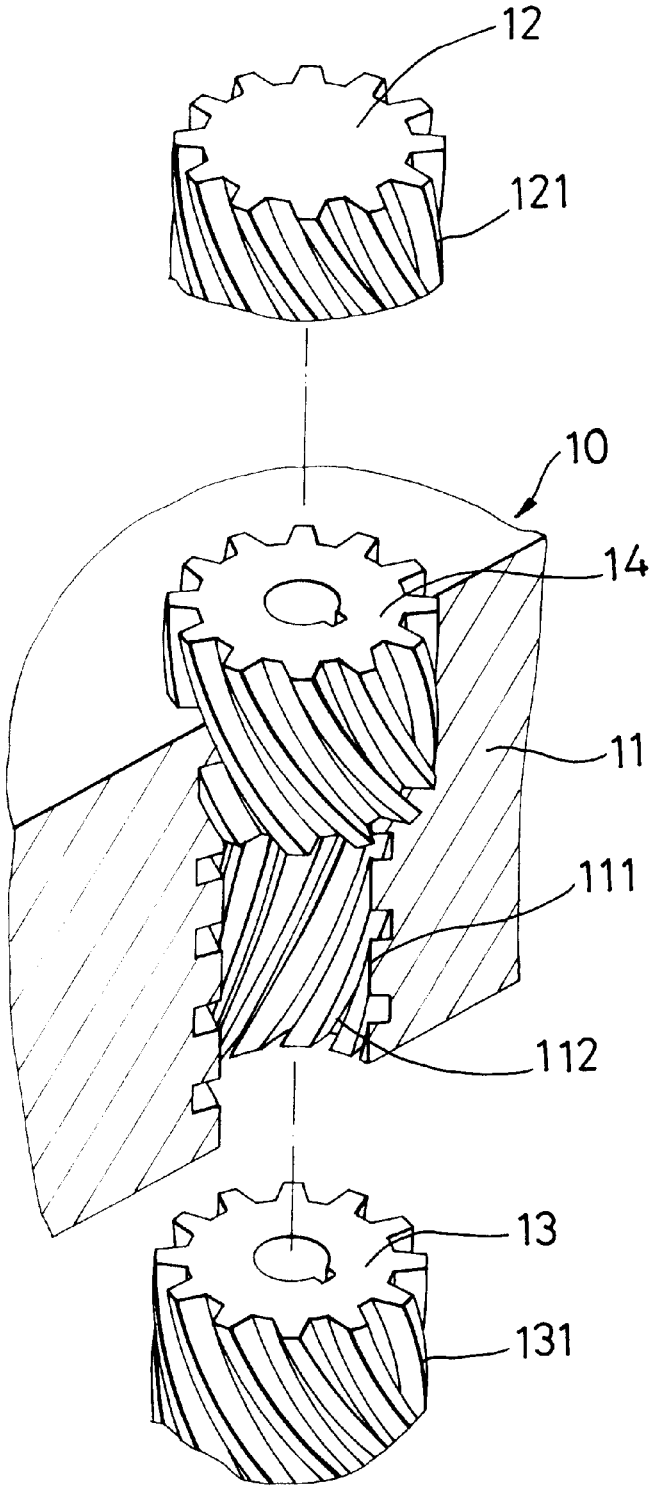
FIG.1 PRIOR ART
FIG. 1 is a perspective view showing a conventional apparatus for forming a spiral gear from metal powders.
Figure 2:
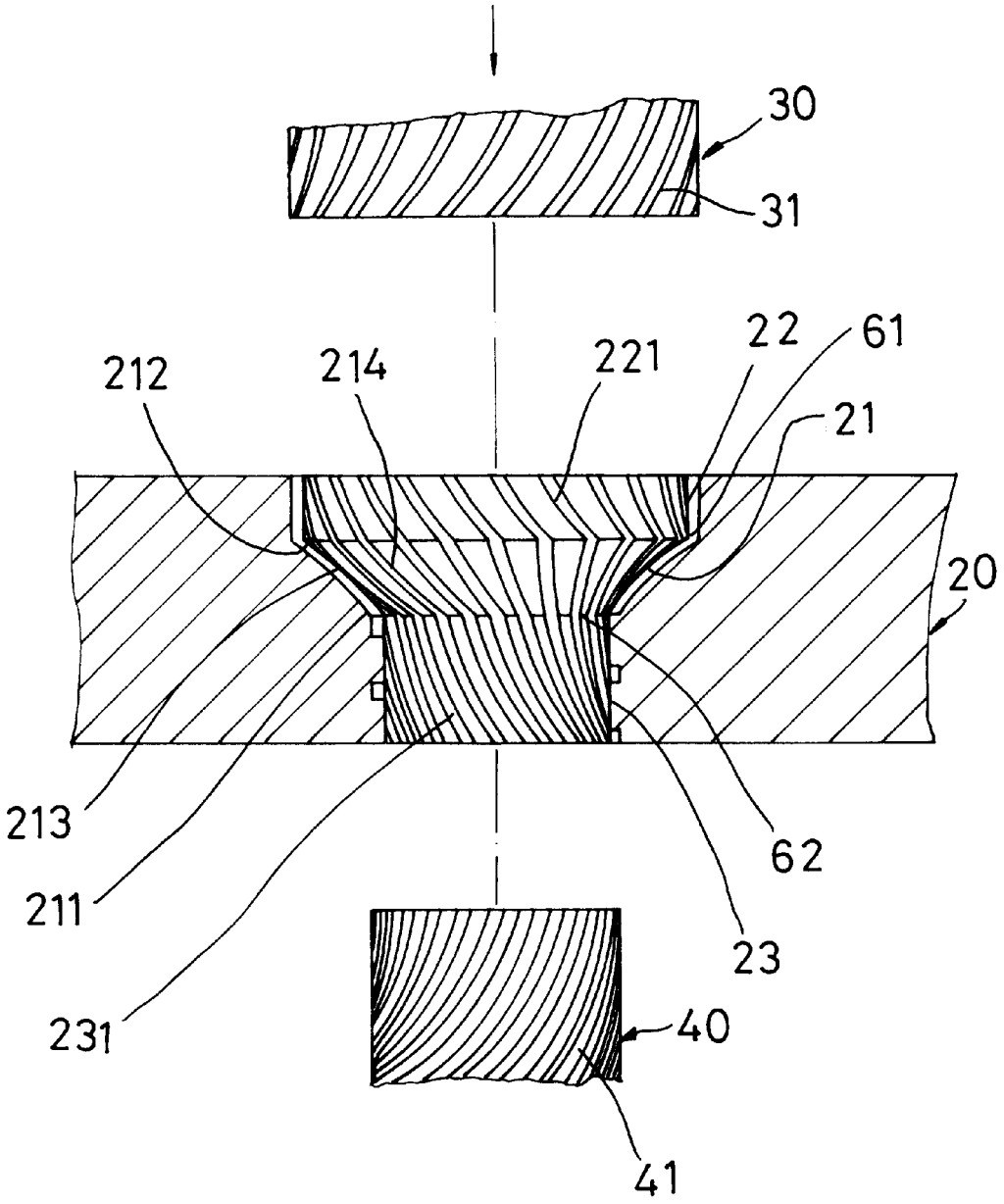
FIG. 2 is a sectional view showing an apparatus with the preferred embodiment of a mold die according to this invention for forming a spiral bevel gear.

Referring to FIG. 2, a preferred embodiment of the method for forming a spiral bevel gear according to the present invention includes the steps of:

(a) providing a cavity of a mold die 20;

The die cavity includes a middle segment 21, an upper segment 22 and a lower segment 23. The middle segment 21 corresponds to a contour of a desired spiral bevel gear (see FIG. 6) which has a first lower annular end, a first upper annular end with a cross-section larger than that of the first lower annular end, a middle skirt portion that extends upwardly and that diverges from the first lower annular end toward the first upper annular end, and a plurality of first spiral teeth disposed angularly in a first outer circumferential wall of the middle skirt portion. Each of the first spiral teeth extends from the first lower annular end to the first upper annular end. Thus, the middle segment 21 has a second lower annular end 211, a second upper annular end 212, and a middle skirt portion 213 having a first inner circumferential wall formed with a plurality of first spiral threads 214 to correspond to the first spiral teeth of the spiral bevel gear.

The upper segment is adapted to correspond to a contour of a first spiral gear 30. The first spiral gear 30 has substantially the same cross-section as that of the first upper annular end of the spiral bevel gear. Preferably, the cross-section of the first spiral gear 30 is somewhat larger than that of the first upper annular end of the spiral bevel gear for facilitating removal of the spiral bevel gear blank (this will be described in greater detail in the succeeding paragraphs) . The first spiral gear 30 has a second outer circumferential wall with a plurality of second spiral teeth 31 which are angularly disposed in the second outer circumferential wall. The upper segment 22 is disposed immediately above the middle segment 21 to form a first juncture 61, and has a second inner circumferential wall with a plurality of second spiral threads 221 to correspond to the second spiral teeth 31. Each second spiral thread 221 conforms to and extends from a respective one of the first spiral threads 214.

The lower segment 23 is adapted to correspond to a contour of a second spiral gear 40. The second spiral gear 40 has substantially the same cross-section as that of the first lower annular end of the spiral bevel gear, and a third outer circumferential wall with a plurality of third spiral teeth 41 which are angularly disposed in the third outer circumferential wall. Thus, the lower segment 23 has a third inner circumferential wall with a plurality of third spiral threads 231 which conform to and extend from the first spiral threads 214, respectively, and is disposed distal to the upper segment 22 immediately beneath the middle segment 21 to form a second juncture 62.

Figure 3:
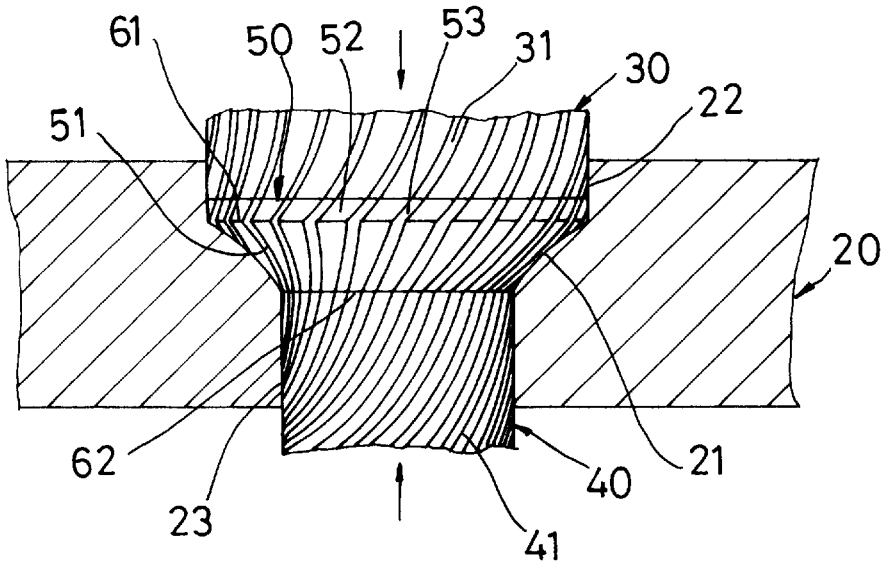
FIG. 3 is a sectional view showing how the apparatus is operated to press metal powders for forming a spiral bevel gear blank.
Figure 4:
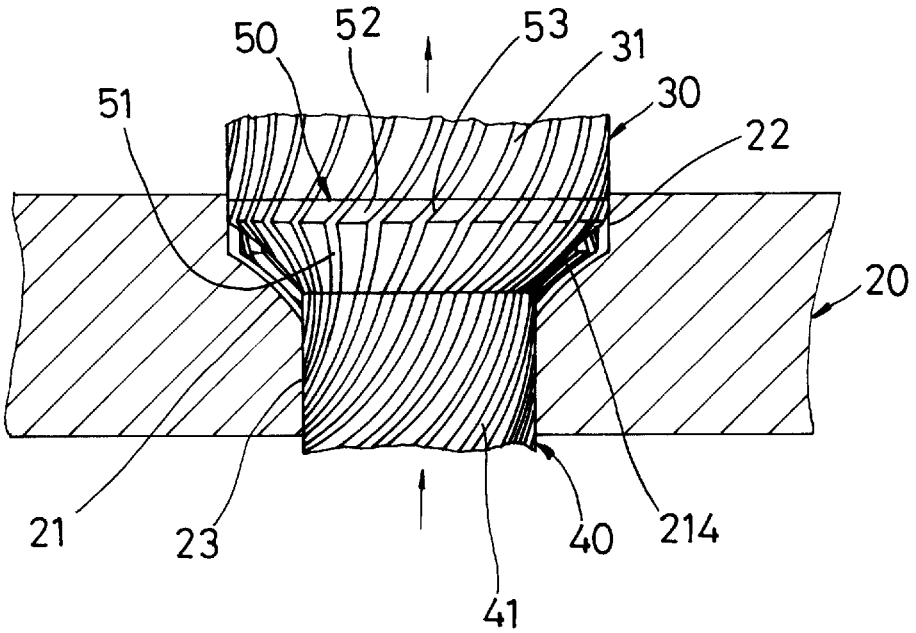
FIG. 4 is a sectional view showing how the apparatus is operated to remove the spiral bevel gear blank out of the mold die in an initial state.
Figure 5:
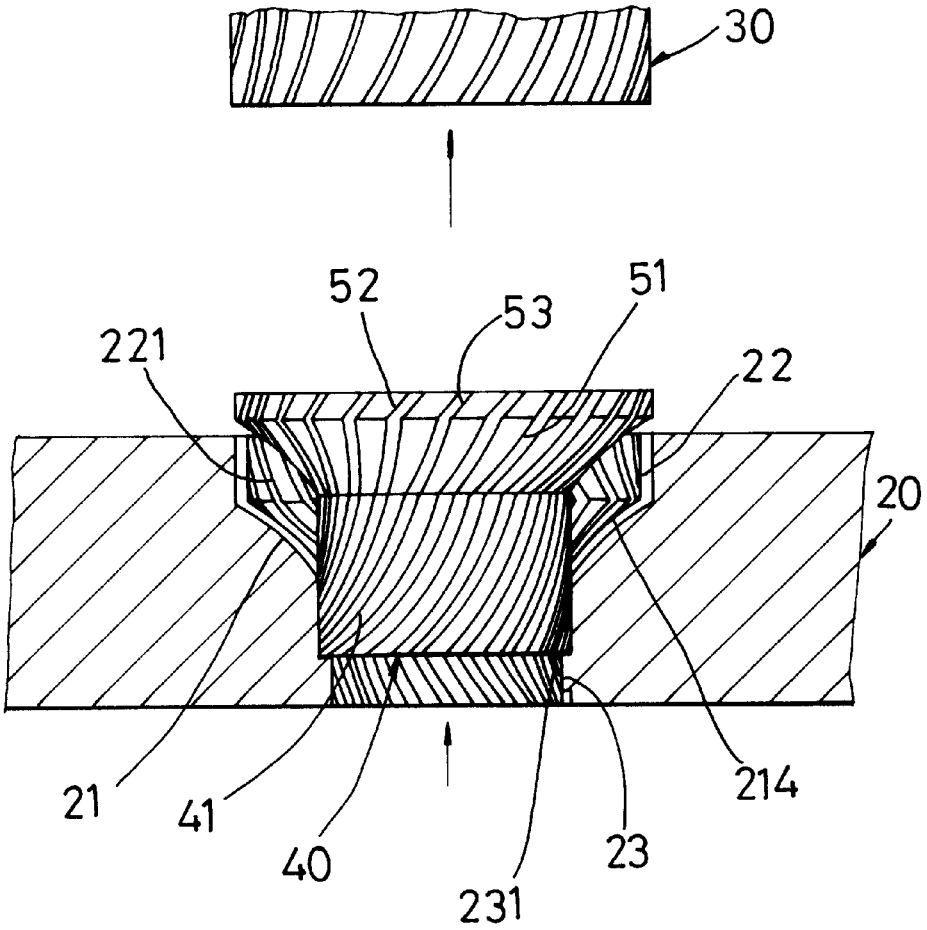
FIG. 5 is a sectional view showing how the apparatus is operated to remove the spiral bevel gear blank out of the mold die in another state.
Figure 6:
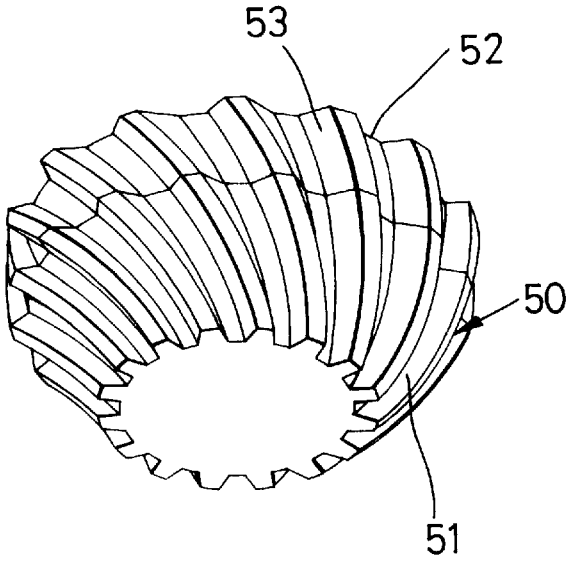
FIG. 6 is a perspective view of the spiral bevel gear blank formed from the mold die of this invention.

(b) as shown in FIG. 3, closing the lower segment 23 from the bottom by screwing the second spiral gear 40 in the lower segment 23;

(c) filling the die cavity with metal powders 50;

(d) closing the cavity by screwing the first spiral gear 30 into the upper segment 22;

(e) pressing the metal powders 50 by continuing the screwing actions of the first and second spiral gears 30,40 until the second spiral gear 40 reaches the second juncture 62 and the first spiral gear 30 stops short on the first juncture 61 to form a green compact 51 which acquires a shape of a combination of the bevel spiral gear and a residual portion 52 of the first spiral gear 30. The residual portion 52 also has a plurality of spiral teeth 53 around its outer circumferential wall which are the same as the second spiral teeth 31 of the first spiral gear 30;

(f) referring to FIG. 4, screwing the first spiral gear 30 out of the first segment 22, as shown in FIG. 5;

(g) gradually screwing the second spiral gear 40 towards the middle segment 21 such that the residual portion 52 is rotated threadedly along the second spiral threads 221 of the upper segment 22 by virtue of threaded engagement between the spiral teeth 53 and the second spiral threads 221 in order to eject the green compact 51 out of the middle and upper segments 21,22;

(h) sintering the green compact 51 to form a bevel spiral gear blank 50, as shown in FIG. 6; and (i) machining the bevel spiral gear blank 50 to cut off the sintered residual portion 52 from the bevel spiral gear blank 50.

As illustrated, the spiral bevel gear blank 50 can be formed by the method according to the present invention, and can be removed easily from the cavity of the mold die in such a manner that the residual portion 52 is rotated gradually along the second spiral threads 221 due to the screwing action of the second spiral gear 40 toward the middle segment 21. Therefore, the method of this invention can eliminate the necessity of further processing, such as the thread milling process for forming the spiral teeth, thereby simplifying the manufacturing processes. Moreover, the product of the spiral bevel gear by the method of the invention can achieve a small tolerance.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A method for forming a spiral bevel gear from metal powders, comprising the steps of:

(a) providing a die cavity which includes a middle segment corresponding to a contour of the spiral bevel gear which has a first lower annular end, a first upper annular end having a cross-section larger than that of the first lower annular end, a middle skirt portion extending upwardly and diverging from the first lower annular end toward the first upper annular end, and a plurality of first spiral teeth angularly disposed in a first outer circumferential wall of the middle skirt portion, each of the first spiral teeth extending from the first lower annular end to the first upper annular end, the middle segment having a plurality of first spiral threads corresponding to the first spiral teeth;

an upper segment corresponding to a contour of a first spiral gear having substantially the same cross-section as that of the first upper annular end, the first spiral gear having a second outer circumferential wall with a plurality of second spiral teeth angularly disposed in the second outer circumferential wall, wherein the upper segment is disposed immediately above the middle segment to form a first juncture, and has a plurality of second spiral threads corresponding to the second spiral teeth, each of the second spiral threads conforming to and extending from a respective one of the first spiral threads; and a lower segment corresponding to a contour of a second spiral gear which has a third outer circumferential wall with a plurality of third spiral teeth angularly disposed in the third outer circumferential wall, wherein the lower segment is disposed distal to the upper segment and is immediately beneath the middle segment to form a second juncture;

(b) closing the lower segment from the bottom by screwing the second spiral gear in the lower segment;

(c) filling the die cavity with metal powders;

(d) closing the cavity by screwing the first spiral gear into the upper segment;

(e) pressing the metal powders by continuing the screwing actions of the first and second spiral gears until the second spiral gear reaches the second juncture and the first spiral gear stops short of the first juncture to form a green compact which acquires a shape of a combination of the bevel spiral gear and a residual portion of the first spiral gear;

(f) screwing the first spiral gear out of the first segment; and (g) gradually screwing the second spiral gear towards the middle segment such that the residual portion is rotated threadedly along the second spiral threads of the upper segment in order to eject the green compact out of the middle and upper segments.

2. A method according to claim 1, further comprising a step of sintering the green compact to form a bevel spiral gear blank.

3. A method according to claim 2, further comprising machining the bevel spiral gear blank to cut off the sintered residual portion from the bevel spiral gear.

4. A method according to claim 1, wherein in said step (a), the second spiral gear has the same cross-section as that of the first lower annular end, and the lower segment has a plurality of third spiral threads, each of the third spiral threads conforming to and extending from a respective one of the first spiral threads.

5. A mold die for forming a spiral bevel gear from metal powders, comprising a die cavity which includes:

a middle segment adapted to correspond to a contour of the spiral bevel gear which has a first lower annular end, a first upper annular end having a cross-section larger than that of the first lower annular end, a middle skirt portion extending upwardly and diverging from the first lower annular end toward the first upper annular end, and a plurality of first spiral teeth angularly disposed in a first outer circumferential wall of the middle skirt portion, each of the first spiral teeth extending from the first lower annular end to the first upper annular end, said middle segment having a plurality of first spiral threads adapted to correspond to the first spiral teeth;

an upper segment adapted to correspond to a contour of a first spiral gear which has substantially the same cross-section as that of said first upper annular end, and a second outer circumferential wall with a plurality of second spiral teeth angularly disposed in the second outer circumferential wall, wherein said upper segment is disposed immediately above said middle segment to form a first juncture, and has a plurality of second spiral threads adapted to correspond to the second spiral teeth, each of said second spiral threads conforming to and extending from a respective one of said first spiral threads; and a lower segment adapted to correspond to a contour of a second spiral gear which has a third outer circumferential wall with a plurality of third spiral teeth angularly disposed in the third outer circumferential wall, wherein said lower segment is disposed distal to said upper segment and is immediately beneath said middle segment to form a second juncture, said lower segment having a plurality of third spiral threads adapted to correspond to the third spiral teeth.

6. The mold die according to claim 5, wherein each of said third spiral threads conforms to and extends from a respective one of said first spiral threads.

* * * * *